US006223151B1

(12) United States Patent
Kleijn et al.

(10) Patent No.: US 6,223,151 B1
(45) Date of Patent: Apr. 24, 2001

(54) METHOD AND APPARATUS FOR PRE-PROCESSING SPEECH SIGNALS PRIOR TO CODING BY TRANSFORM-BASED SPEECH CODERS

(75) Inventors: Willem Bastiaan Kleijn, Stocksund; Thomas Eriksson, Gothenborg, both of (SE)

(73) Assignee: Telefon Aktie Bolaget LM Ericsson (SE)

( * ) Notice: Subject to any disclaimer, the term of this patent is extended or adjusted under 35 U.S.C. 154(b) by 0 days.

(21) Appl. No.: 09/248,162

(22) Filed: Feb. 10, 1999

(51) Int. Cl.[7] ..... G10L 11/04; G10L 19/02; G10L 19/04

(52) U.S. Cl. ..... 704/207; 704/203; 704/219

(58) Field of Search ..... 704/203, 207, 704/219

(56) References Cited

U.S. PATENT DOCUMENTS 5,704,003 12/1997 Kleijn et al. ..... 704/216

OTHER PUBLICATIONS

R.J. McAulay and T.F. Quatieri, "Sinusoidal Coding" in *Speech Coding and Synthesis*, (W.B. Kleijn and K.K. Paliwal, Editors), Elsevier Science, 1995, pp. 121–173.

J. Haagan and W.B. Kleijn, "Waveform Interpolation for Coding and Synthesis" in *Speech Coding and Synthesis*, (W.B. Kleijn and K.K. Paliwal, Editors), Elsevier Science, 1995, pp. 175–207.

I.S. Burnett and D.H. Pham, "Multi–Prototype Waveform Coding Using Frame–by–Frame Analysis–By–Synthesis", Proc. International Conf. Acoust. Speech Sign. Process, 1997, pp. 1567–1570.

Y. Shoham, "Very Low Complexity Interpolative Speech Coding at 1.2 to 2.4KBPS", Proc. International Conf. Acoust. Speech Sign. Process., 1997, pp. 1599–1602.

T.E. Tremain, "The Government Standard Linear Predictive Coding Algorithm: LPC–10", Speech Technology, Apr., 1982, pp. 40–49.

J. Haagen and W. B. Kleijn, "Waveform Interpolation", *in Modern Mehtods of Speech Processing*, Kluwer, Dordrecht, Holland, 1995, pp. 75–99.

W.B. Kleijn, R.P. Ramachandran and P. Kroon, "Interpolation of the Pitch–Predictor Parameters in Analysis–by–Synthesis Speech Coders", IEEE Transactions on Speech and Audio Processing, vol. 2, No. 1, Part I, Jan. 1994, pp. 42–54.

W.B. Kleijn, H. Yang and E.F. Deprettere, "Waveform Interpolation Coding With Pitch–Spaced Subbands"; Proc. International Conf. Speech and Language Process., 1988, pp. 1795–1798.

(List continued on next page.)

*Primary Examiner*—Tālivaldis I. Šmits
(74) *Attorney, Agent, or Firm*—Jenkens & Gilchrist, P.C.

(57) ABSTRACT

A method and apparatus which is used to precondition a speech signal such that the signal has relatively low power at predetermined points which form the boundaries of DFT blocks in a coder. The method and apparatus is particularly effective when the filter bank operates on a linear-prediction residual. The requirement of having low energy at the block boundary is well approximated by a requirement of having a pitch pulse near the center of the block. The method and apparatus makes it possible to make the difference between the original speech signal and the pre-processed speech signal inaudible or nearly inaudible. An AE coder which follows the pre-processor, therefore, reconstructs a quantized version of the pre-processed speech. The present invention differs from earlier pre-processors in its operation, in the properties of the modified speech signal, and in the fact that it is compatible with a sinusoidal or waveform-interpolation type of speech coder.

22 Claims, 2 Drawing Sheets-

OTHER PUBLICATIONS

P.P. Vaidyanathan, "Paraunitary Perfect Reconstruction (PR) Filter Banks" (Chapter 6), *Multirate Systems and Filter Banks*, Prentice Hall, 1993, pp. 286–336.

W. Hess, "General Discussion: Summary, Error Analysis, Applications" (Chapter 9), *Pitch Detrmination of Speech Signals*, Springer Verlag, Berlin, 1983, pp. 472–501.

W.B. Kleijn, "Encoding Speech Using Prototype Waveforms", *IEEE Trans. Speech and Audio Process.*, vol. 4, pp. 386–399.

S. Mallat, "A Wavelet Tour of Signal Processing", Academic Press, 1998, pp. 127–164.

ICSP '98: International Conference on Signal Processing, Beijing, China, Oct. 1998, "Pitch Synchronous Modulated Lapped Transform of the Linear Prediction Residual of Speech," Huimin Yang et al., vol. 1, pp. 591–594, XP002115036.

Digital Signal Processing, Orlando, Florida, Oct. 1, 1991, "*Methods for Waveform Interpolation in Speech Coding*," W. Bastiaan Kleijn et al., vol. 1, No. 4, pp. 215–230, XP000393617.

Stephane Mallat, "A Wavelet Tour of Signal Processing," Academic Press, 1998, pp. 127–164.

R. Taori, R.J. Sluijter and E. Kathmann; "*Speech Compression Using Pitch Synthronous Interpolaiton*"; Sep. 5, 1995 pub. date; pp. 512–5–15.

Thomas Eriksson and W. Bastiaan Kleijn; "*On Waveform–Interpolation Coding wit Asymtotically Perfect Reconstruction*"; Jan.–Sep. 1999; pp. 93–95.

METHOD AND APPARATUS FOR PRE-PROCESSING SPEECH SIGNALS PRIOR TO CODING BY TRANSFORM-BASED SPEECH CODERS

FIELD OF THE INVENTION

The invention relates generally to the coding of speech signals in communication systems and, more particularly, but not by way of limitation, to the coding of speech with speech coders using block transforms.

BACKGROUND OF THE INVENTION

High quality coding of speech signal s at low bit rates is of great importance to modern communications. Applications for such coding include mobile telephony, voice storage and secure telephony, among others. These applications would benefit from high quality coders operating at one to five kilobits per second. As a result, there is a strong research effort aimed at the development of coders operating at these rates. Most of this research effort is directed at coders based on a sinusoidal coding paradigm (e.g. R. J. McAulay and T. F. Quatieri, "Sinusoidal Coding", in Speech Coding and Synthesis, W. B. Kleijn and K. K. Paliwal, editors, Elsevier Science, 1995, pages 121–173.) and a waveform interpolation paradigm (e.g., W. B. Kleijn, "Encoding Speech Using Prototype Waveforms", IEEE Trans. Speech and Audio Process., vol. 4, pages 386–399, 1993). Furthermore, several standards based on sinusoidal coders already exist, for example, INMARSAT Mini-M 4 kb/s, and APCO Project 25 North American land mobile radio communication system.

Coders operating at bit rates greater than five kilobits per second commonly use coding paradigms for which the reconstructed signal is identical to the original signal when the quantization errors are zero (i.e. when quantization is turned off). In other words, signal reconstruction becomes exact when the operational bit rate approaches infinity. Such coders are referred to as Asymptotically Exact (AE) coders. Examples of standards which conform with such coders are the ITU G.729 and G.728 standards. These standards are based on a commonly known Code-Excited Linear Prediction(CELP) speech-coding paradigm. AE coders have an advantage in that the quality can be improved by increasing the operational bit rate. Thus, any shortcomings in models of the speech signal used by an AE coder which result in human perception can be compensated for by increasing the operational bit rate. As a result, any de-tuning of parameter settings in a good AE coder increases the required bit rate necessary to obtain a certain quality of the reconstructed speech. In practice, a majority of AE coders employ bit rates which result in the quality of the reconstructed speech to be of a good to excellent quality. Hereinafter, the meaning of "good" and "excellent" are defined by descriptions contained in the commonly known Mean Opinion Score (MOS) which is based on a subjective evaluation.

For most speech-coding paradigms implemented at bit rates below five kilobits per second, the reconstructed signal does not converge to the original signal when the quantization errors are set to zero. Hereinafter, such coders are referred to as parametric coders. Parametric coders are typically based on a model of the speech signal which is more sophisticated than those used in waveform coders. However, since these coders lack the AE property of improved reconstruction signal quality with increased bit rates, slight shortcomings in the model may greatly affect the quality of the reconstructed speech signal. Relatively seen, this effect on quality is most important with the use of high bit rate quantizers. Thus, the quality of the reconstructed speech signal cannot exceed a certain fixed maximum level which is primarily dependent on the particular model. Generally this maximum quality level is below a "good" rating on the MOS scale.

It would be advantageous therefore, to modify promising parametric coders to operate as AE coders. First, usage of sophisticated speech-signal models associated with parametric coders results in an efficient coding. Second, conversion to an AE coder removes limitations on the quality of the reconstructed speech associated with parametric coders. To convert a parametric coder to an AE coder, however, the parametric coder needs to be amenable to such a modification. As will be described below, the waveform interpolation coder is indeed amenable to such a change. Furthermore, use of the present invention allows certain sinusoidal coders to be converted from parametric coders to AE coders as well.

Until recently, all versions of commonly known waveform interpolation coders (e.g. I. S. Burnett and D. H. Pham, "Multi-Prototype Waveform Coding Using Frame-by-Frame Analysis-by-Synthesis", Proc. International Conf. Acoust. Speech Sign. Process., 1997, pages 1567–1570, and Y. Shoham, "very Low Complexity Interpolative Speech Coding at 1.2 to 2.4 kbps", Proc. International Conf. Acoust. Speech Sign. Process., 1997, pages 1599–1602.) were parametric coders. Since the quality of the reconstructed speech signal is limited by the particular model, implementations of waveform interpolation coders have been designed at bit rates of approximately two thousand four hundred bits per second where the shortcomings of the model are least apparent.

Recently, two AE versions of the waveform interpolation coder were proposed (W. B. Kleijn, H. Yang, and E. F. Deprettere, "Waveform Interpolation With Pitch-Spaced Subbands", Proc. International Conf. Speech; and Language Process., 1998 pages 1795–1798). The basic coder operation is the same in both versions. Using either version of the proposed waveform interpolation coders, a pitch period track of the speech signal is estimated by a pitch tracking unit which uses standard commonly known techniques, with the pitch period track also continuing in regions of no discernable periodicity. Hereinafter, a speech signal is defined to be either the original speech signal or any signal derived from a speech signal, for example, a linear-prediction residual signal.

A digitized speech signal and the pitch-period track form an input to a time warping unit which outputs a speech signal having a fixed number of samples per pitch period. This constant-pitch-period speech signal forms an input to a nonadaptive filter bank. The coefficients coming out of the filter bank are quantized and the corresponding indices encoded with the quantization procedure potentially involving multiple steps. At the receiver, the quantized coefficients are reconstructed from the transmitted quantization indices. These coefficients form an input to a synthesis filter bank which produces the reconstructed signal as an output. The filter banks are perfect reconstruction filter banks (e.g., P. P. Vaidyanathan, "Multirate Systems and Filterbanks", Prentice Hall, 1993) which result in an perfect reconstruction when the analysis and synthesis banks are concatenated, that is to say, when the quantization is turned off. Thus, the coder possesses the AE property if an appropriate unwarping procedure is used.

In the two AE versions of the waveform interpolation coder described above, a Gabor-transform and a Modulated Lapped Transform (MLT) were used as filter banks, respectively. Both procedures suffer from disadvantages which are difficult to overcome in practice. A primary disadvantage exhibited by both procedures is of increased delay. In general, the Gabor-transform based waveform interpolation coder requires an over-sampled filter bank for good performance. This means that the number of coefficients to be quantized is larger than the original speech signal, which is a practical disadvantage for coding. When the MLT is used, the coder parameters are not easily converted into either a description of the speech waveforms or a description of the harmonics associated with voiced speech. This makes it more difficult to evaluate the effects of time-domain and frequency-domain masking.

In the Gabor-transform approach, the reconstructed signal is a summation of smoothly windowed complex exponential (sinusoid) functions (vectors). The scaling and summing of the functions is equivalent to the implementation of the synthesis filter bank. The coefficients for each of these windowed exponential functions form the representation to be quantized. In speech coding applications, the main purpose of the smooth window is to prevent any discontinuities of the energy contour of the reconstructed signal upon quantization of the coefficients. If such discontinuities are present, they become audible in voiced speech segments which is the focus of the present invention. Furthermore, a commonly known Balian-Low theorem (e.g., S. Mallat, "A Wavelet Tour of Signal Processing", Academic Press, 1998) implies that a smooth window can be used only in combination with over sampling. Therefore, over sampling cannot be eliminated when the Gabor-transform based approach is used for a speech signal.

With a square window, the Gabor-transform filter bank can be critically sampled. This is convenient for coding since the output of the analysis filter bank has the same number of coefficients (samples) as the original signal had samples. Furthermore, in the case of a square window and critical sampling, the Gabor-transform filter bank reduces to the commonly known block Discrete Fourier Transform (DFT) which is attractive from a computational and a delay viewpoint. Unfortunately, quantization of the coefficients results in discontinuities of the energy contour of the reconstructed signal.

It would be advantageous therefore, to devise a method and apparatus for pre-processing speech signals to create a pre-conditioned speech signal which eliminates the problems associated with the block-DFT based approach.

SUMMARY OF THE INVENTION

The present invention includes a pre-processor which is used to precondition a speech signal such that the signal has relatively low power at predetermined points which form the boundaries of DFT blocks in a coder. This procedure is particularly effective when the filter bank operates on a linear-prediction residual which is commonly known to have a peaky character during voiced speech. The requirement of having low energy at the block boundary is well approximated by a requirement of having a pitch pulse near the center of the block. The present invention is based on the premise that it is possible to make the difference between the original speech signal and the pre-processed speech signal inaudible or nearly inaudible. An AE coder which follows the pre-processor, therefore, reconstructs a quantized version of the pre-processed speech. The present invention differs from earlier pre-processors in its operation, in the properties of the modified speech signal, and in the fact that it is compatible with a sinusoidal or waveform-interpolation type of speech coder.

DETAILED DESCRIPTION

The following materials are incorporated herein by reference:

R. J. McAulay and T. F. Quatieri, "Sinusoidal Coding", in Speech Coding and Synthesis, W. B. Kleijn and K. K. Paliwal, editors, Elsevier Science, 1995, pages 121–173; W. B. Kleijn, "Encoding Speech Using Prototype Waveforms", IEEE Trans. Speech and Audio Process., vol. 4, pages 386–399, 1993; I. S. Burnett and D. H. Pham, "Multi-Prototype Waveform Coding Using Frame-by-Frame Analysis-by-Synthesis", Proc. International Conf. Acoust. Speech Sign. Process., 1997, pages 1567–1570; Y. Shoham, "Very Low Complexity Interpolative Speech Coding at 1.2 to 2.4 kbps", Proc. International Conf. Acoust. Speech Sign. Process., 1997, pages 1599–1602; W. B. Kleijn, H. Yang, and E. F. Deprettere, "Waveform Interpolation With Pitch-Spaced Subbands", Proc. International Conf. Speech; and Language Process., 1998 pages 1795–1798; P. P. Vaidyanathan, "Multirate Systems and Filterbanks", Prentice Hall, 1993; S. Mallat, "A Wavelet Tour of Signal Processing", Academic Press, 1998; T. E. Tremain, "The Government Standard Linear Predictive Coding Algorithm" Speech Technology, April 1982, pages 40–49; W. B. Kleijn, R. P. Ramachandran, and P. Kroon, "Interpolation of the Pitch-Predictor Parameters in Analysis-by-Synthesis Speech Coders", IEEE Trans. Speech and Audio Process., 1994 pages 42–54; J. Haagen and W. B. Kleijn, "Waveform Interpolation", in "Modern Methods of Speech Processing", Kluwer, Dordrecht, Holland, 1995, pages 75–99; W. Hess, "Pitch Determination of Speech Signals", Springer Verlag, Berlin, 1983.

Figure 1:
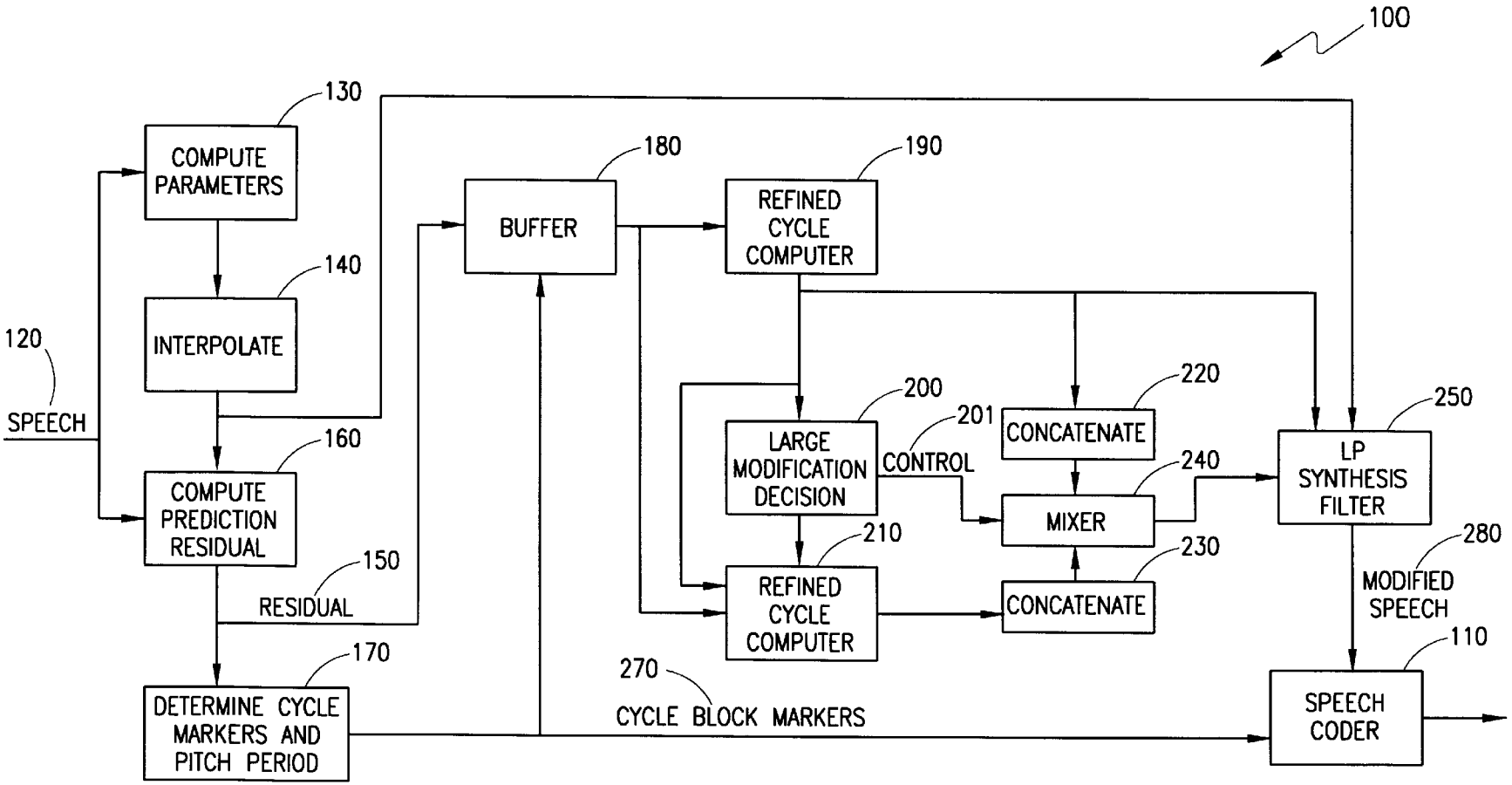
FIG. 1 is a functional block diagram of a preferred embodiment of the present invention.
Figure 2:
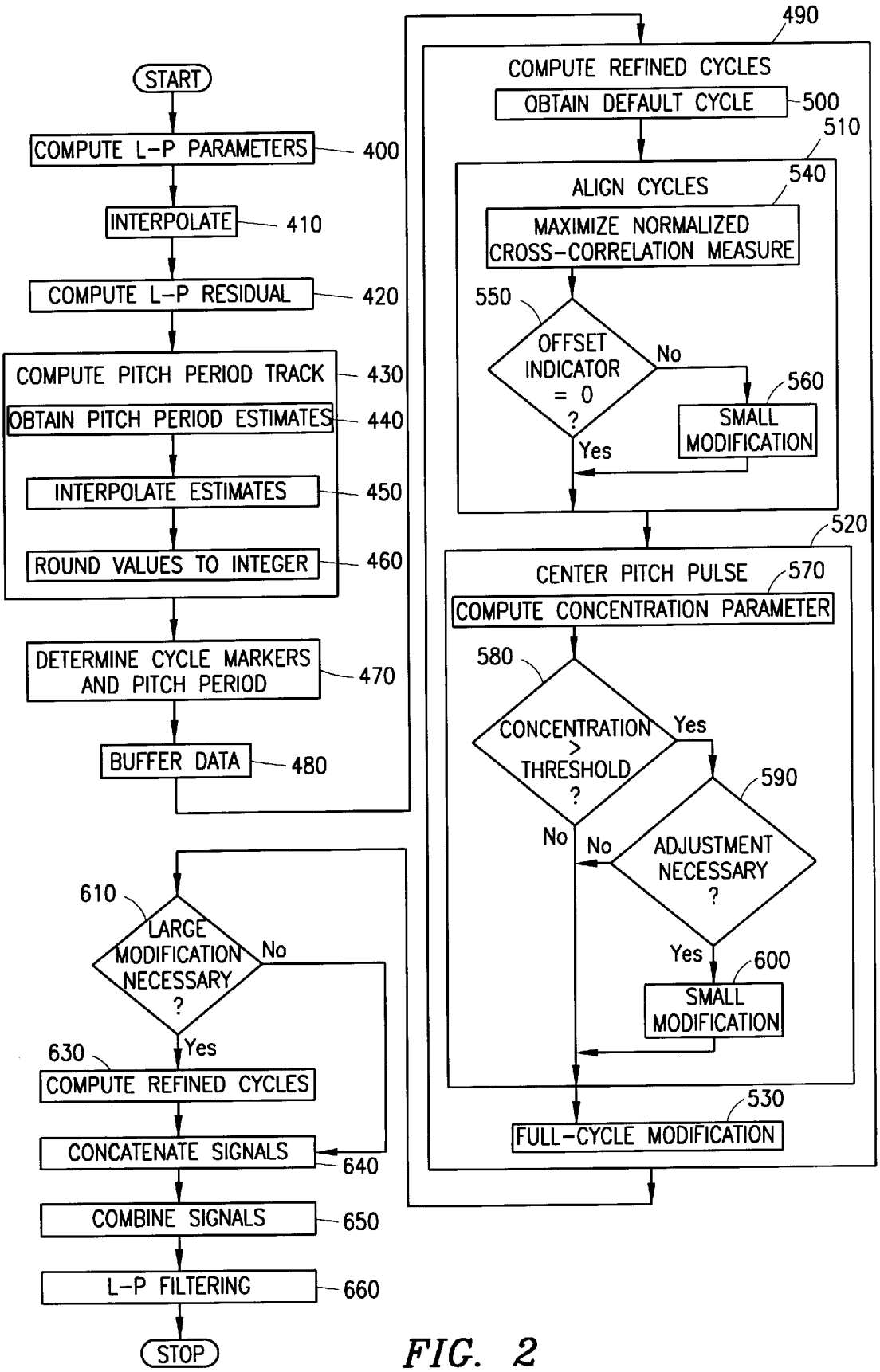
FIG. 2 is a flow diagram of a method for implementing the preferred embodiment of the present invention.

Referring now to FIGS. 1 and 2 there is illustrated a functional block diagram of a preferred embodiment of the present invention and a flow diagram of a method for implementing the preferred embodiment of the present invention.

The aim of the present invention is to modify a linear-prediction residual of a speech signal so that the modified linear-prediction residual can be coded using a Speech Coder based on simple block transforms using rectangular windows. The information pertaining to cycle markers is shared by a pre-processor (shown generally at 100) of the present invention and a speech coder 110. Using conventional methods and devices commonly known in the industry, a speech signal 120 is processed by a parameter processor 130 to compute a set of linear-prediction parameters (step 400), an interpolation is performed (step 410) by an interpolator 140, and a linear-prediction residual 150 of the speech signal 120 is computed (step 420) by residual processor 160. In one embodiment of the present invention, a linear-prediction order is set to ten for an eight thousand hertz sampled speech signal. The linear-prediction residual and parameter sequences are, in one embodiment, available for at least half a pitch period ahead of the output of the present invention plus a small number of additional samples.

A pitch period processor 165 computes a first pitch period track (step 430). To compute the first pitch period track, the pitch period processor 165 obtains pitch period estimates (step 440). The pitch period is estimated, in one embodiment, at twenty millisecond intervals and while any conventional pitch estimation procedure can be used, the preferred embodiment of the present invention uses the procedure described in J. Haagen and W. B. Kleijn, "Waveform Interpolation", in "Modern Methods of Speech Processing", Kluwer, Dordrecht, Holland, 1995, pages 75–99. An overview of some of other procedures can be found in, W. Hess, "Pitch Determination of Speech Signals", Springer Verlag, Berlin, 1983.

Upon obtaining the pitch-period estimates on twenty millisecond intervals, the pitch period estimates are linearly interpolated on a sample-by-sample basis (step 450) to obtain the first pitch-period track. The values of the first pitch-period track are rounded to an integer number of sampling intervals (step 460).

Cycle markers based on the first pitch-period track and a pitch period are determined (step 470) by a cycle marker processor 170 and the data is buffered (step 480) in buffer 180. The present invention requires no other information to locate the cycle markers. The cycle markers, by definition, bound pitch cycles, which are referred to hereinafter as "cycles". The pitch period within a cycle is redefined as the distance between the cycle markers bounding the particular cycle. This definition of the pitch period creates a second pitch-period track. The cycle markers are defined solely on the basis of the first pitch-period track and an initial condition. In the speech coder the cycle markers form block boundaries of the transforms.

As previously stated, the primary objective of the present invention is to modify the speech signal such that the energy of the modified linear-prediction residual is low near the cycle- markers while at the same time maintaining the quality of the original speech signal. This objective results in three requirements for the output of the pre-processor. First, for voiced speech, the waveforms of consecutive cycles need close to perfect alignment which is defined as maximizing a normalized cross-correlation measure. Second, when existent, the pitch pulse needs to be near the center of the cycle. Third, the output needs to be perceptually identical to the original signal.

To meet these requirements, the present invention performs a mapping from the original signal to the modified signal including skipping and repeating samples according to set rules. It is noted that, since the first pitch-period track is generally an approximation, a trade-off between the precision of the alignment and the accuracy of the pulse centering exists and, therefore, any embodiment of the present invention provides an implicit balancing of these trade-offs. Modifications are performed on the linear-prediction residual of the speech signal where the pitch pulses are relatively well-defined and further, where low-energy regions are found between consecutive pitch pulses.

The present invention identifies three possible approaches for performing sample skipping and repetition. The three approaches are stated below with P denoting the pitch period measured in a number of samples of a current cycle.

A first approach is to perform small modifications where an integer number of samples, not larger than P/20, are skipped or repeated. These modifications are performed to keep consecutive extracted pitch cycles aligned and to keep the pitch pulse close to the center of the block.

A second approach is to perform large modifications where an integer number of samples of up to P/2 are skipped or repeated. This method is utilized at an onset of a voiced region to insure that the first pitch pulse is properly centered in the pre-defined cycles.

A third approach is to perform full-cycle modifications where a full pitch cycle(P samples) is removed or repeated. This method compensates for the accumulated delay or advance of a time pointer introduced by outputs of the previous two approaches.

While it is possible to make all three types of modifications inaudible to the human auditory system, it is particularly critical that large modifications are performed only where needed.

As will be described below, for each cycle the present invention determines if any of the above three modifications are desirable. To make this determination, several parameters are extracted from the original linear prediction residual and the past modified linear prediction residual signal. A first parameter is Periodicity, r, and is defined as a normalized cross correlation between a current cycle and a previous cycle. Its value is close to one for a highly periodic signal. A second parameter is Concentration, c, which indicates a concentration of energy in a pitch cycle. If the pitch cycle resembles an impulse, the value of the concentration parameter is close to one, otherwise, its value is less than one. A third parameter is Pitch Pulse Location which is a ratio of a location of a maximum sample value within the cycle and the pitch period. This value is bounded between zero and one. A fourth parameter is Accumulated Shift which is an accumulated sum of large, small and full-cycle modifications. It is noted that in an alternative embodiment of the present invention, a measure using the energy of the signal is exploited as an additional parameter.

To determine the cycle markers and pitch period in step 470, the first pitch-period track is processed in a recursive manner to obtain the cycle markers and the pitch period associated with each cycle. Let k be a sample index, p(k) be the first pitch-period track, q be a cycle index, m(g) and m(q+1) the cycle markers (in samples) for cycle q, and P(g) the pitch period for cycle q. Assume that m(q) and p(k) are known, the following recursive procedure is used to find the cycle marker m(q+1) and the pitch period P(q) (set m(0)=0)): First, P(q)=p(m(q)), and second m(q+1)=m(q)+P(q). This procedure is used recursively. It is noted that the cycle markers depend only on the first pitch-period track and the initial marker and that the initial marker is defined only at start-up.

To better understand the present invention, consider a case where the present invention has just finished cycle q−1 and is to start on cycle g. It is convenient to describe the cycle q as a vector. Hereinafter, $\xi(q)$denotes a vector of samples from m(q) to m(q+1)−1 of the modified signal. In the present invention, cycle q is extracted as a continuous sequence of samples from the original signal and concatenated with the existing modified signal. More particularly, cycle q is placed in succession, that is to say, linked with the existing part of the modified signal extending from m(q−1) backwards. In the extraction, the following parameters are used:

q: cycle index;

m(q): markers bounding the cycles in the modified signal;

P(q): pitch period;

$P_{MAX}$: maximum allowed pitch period;

s(k): modified linear-prediction residual;

s'(k): original linear-prediction residual signal;

m'(q): markers which correspond to the first sample of the extracted cycle q in the original signal s'(k);

$\xi(q)$ cycle q, a vector of dimension P(q);

$\bar{\xi}(q)$: vector $\xi(q)$ zero-padded to dimension $P_{max}$; and j: local offset indicator: $j=m'(q)-m'(q-1)-P(g)$.

In the present invention, a first refined cycle computer 190 computes a first set of refined cycles (step 490) by obtaining a default estimate of cycles (step 500), aligning the cycles (step 510), centering a pitch pulse (step 520), and performing a full-cycle modification (step 530). As the default estimate of cycle q, an extraction based on no modification of the signal: $m'(q)=m'(q-1)+P(q-1)$ is used. Thus, the default estimate of the vector $\xi(q)$ includes a sequence of samples $s(m'(q))$ through $s(m'(q)+P(q)-1)$.

To align the cycles, a first refinement is obtained by maximizing a normalized cross-correlation measure (step 540). The normalized cross-correlation measure is a measure of similarity between the cycles q-1 and q of the modified signal:

$$r(q)=\frac{\bar{\xi}(q)^T\bar{\xi}(q-1)}{\sqrt{(\bar{\xi}(q-1)^T\bar{\xi}(q-1)\bar{\xi}(q)^T\bar{\xi}(q))}}$$

where the superscript $^T$ indicates transposition. The cycle q, that is, the vector $\xi(q)$, is selected from the set of sequences of P(q) samples in length which start within P(q)/10 samples of $m'(q-1)+P(q-1)$. First the corresponding maximum value r(q)is found over all sequences of the set. If this is below a threshold $r_{thresh}$, then the previously mentioned default vector with index $m'(q)=m'(q-1)+P(q-1)$ as first component is selected as $\xi(q)$. If the maximum normalized cross correlation satisfies $r(q)>r_{thresh}$ then the vector corresponding to this maximum is selected. A determination is made as to whether j is not equal to 0 (step 550) after the first refinement, and if so, a small modification is performed (step 560).

To center the pitch pulse and obtain a second refinement of cycle g, a concentration parameter is computed (step 570). The concentration parameter, c, is determined as follows: find a maximum component of $\xi(q)$, denote its value by $\max1(\xi(q))$ and its index by $\max loc(\xi(q))$. Next search again for the maximum in $\xi(q)$ , but do not consider components whose index is within P(q)/10 of $\max loc(\xi(q))$ and call this maximum $\max2(\xi(q))$. Define the concentration in cycle q as $$c(q)=1-\frac{\max2(\xi(q))}{\max1(\xi(q))}$$

It is noted that the concentration is bounded below one. A determination is made as to whether the concentration is above a threshold, $c(q)>c_{thresh}$, (step 580), and if so, an additional determination is made as to whether j requires an adjustment (step 590). One sample is subtracted from j if $\max loc(s(q))-P(q)/2>P(q)/5$ and one sample is added to j if $\max loc(s(q))-P(q)/2<-P(q)/5$ (step 600). Thus, centering of the pitch pulse is performed only if the pitch pulse is well-defined and not near the center. The pitch pulse centering operation falls in the class of earlier defined small modifications.

The time shifts resulting from the modifications can accumulate to large delays or advances and inevitably do so and therefore full-cycle modifications are performed (step 530). The advance or delay is indicated by $m(q)-m'(q)$, where $m'(q)=m'(q-1)+P(q-1)+j$. If $m(q)-m'(q)>P(q)/2+P(q)/10$ then the pre-processor sets $m'(q)=m'(q-1)$, that is, a cycle of the original linear-prediction residual is skipped. If $m(q)-m'(q)<-P(q)/2-P(q)/10$, then the pre-processor sets $m'(q)=m'(q-1)+P(q-1)+P(q)$ (The P(q)/10 term in the inequalities is present to introduce hysteresis effects.) These full-cycle modifications can be omitted for applications which do not require short delay, for example, voice storage.

The sequential extractions of the cycles are grouped into frames twenty milliseconds in length. When a pre-processed frame is completed, a determination is made as to whether a large modification is necessary (step 610 and processor 200). The large modification is employed if for any cycle of the frame all of the following conditions are true: first, the signal is periodic, (i.e. if $r(q)>r_{thresh}$), second, the signal power is concentrated, (i.e. if $c(q)>c_{thresh}$), and third, abs $(\max loc(s(q))-P(q)/2)>P(q)/5$ from the cycle center. Situations where all conditions hold are characteristic of the onset of voiced regions, where the pulses' locations are not properly initialized.

If the large modification is necessary, a second refined cycle computer 210 computes a second set of refined cycles (step 630) similar to the process described in step 490. The entire frame is pre-processed again with m'(q) for the first cycle of the frame replaced by $m'(q)-\max loc(s(q))+P(q)/2$. Thus, two pre-processed signals are available for the present frame, the first estimate $s_1(k)$and the second estimate $s_2(k)$.

A first concatenator 220 and a second concatenator 230 concatenate (step 640) the first pre-processed signal and the second pre-processed signals respectively where it is noted that the second signal is constructed only if large modifications are necessary. The two estimates are combined (step 650) by mixer 240. The mixer 240 has as an output the first estimate $s_1(k)$ if no large modifications are necessary. If large modifications are necessary, then the first and second estimates are added according to $s(k)=(1-w(k))s_1(k)+w(k)s_2(k)$, where w(k) increases linearly from zero to one over the twenty millisecond frame.

The modified linear-prediction residual signal s(k) is fed through the inverse of the linear-prediction analysis filter 250 to perform linear-prediction filtering (step 660). The filtering is such that exact reconstruction results when the modified residual signal equals the unmodified residual signal. Consider a filter change at time index k. The procedure finds $q=\arg\max_q\{m'(q): m'(q)\leqq k\}$ and then the filter-parameter change is performed at the synthesis side at min $(m(q)+P(m(q)), m(q)+k-m'(q))$ . The block markers 270 and modified speech signal 280 are fed to the speech coder 110.

As can be seen from the foregoing detailed description, the present invention provides, among others, the following advantages over the prior art:

The present invention modifies a first signal to create a second signal so that the signal power of the second or a third signal based on the second signal is low at time instants which are based on processing blocks used in a coder. Furthermore, the present invention allows the use of coders which use a block transform.

The present invention modifies a first signal to create a second signal so that the signal power of the second or a third signal based on the second signal is high at time instants which are based on processing blocks used in a coder. Furthermore, the present invention allows the use of coders which use a block transform.

The present invention modifies a first signal to create a second signal so that the signal power of the second signal or a third signal based on the second signal is low at time instants which are based on processing blocks used in a coder and where no information is transferred from the coder to the modification unit.

The present invention modifies a first signal to create a second signal so that the signal power of the second signal or a third signal based on the second signal is high at time instants which are based on processing blocks used in a coder and where no information is transferred from the coder to the modification unit.

The present invention modifies a first signal to create a second signal so that the signal power of the second signal or a third signal based on the second signal is low at pre-determined time instants.

The present invention modifies a first signal to create a second signal so that the signal power of the second signal or a third signal based on the second signal is high at pre-determined time instants.

The present invention constructs cycle markers based on a pitch-period track or pitch track to create a second signal from a first signal by concatenation of segments of the first signal based on the cycle markers and a selection criterion. Furthermore, in the present invention, the selection criterion is based on the distribution of energy of the first signal.

The present invention includes a pre-processor unit intended for speech coding which has as output a modified speech signal and markers and where said markers indicate locations where the signal energy of said modified speech signal is relatively low. Furthermore, in the present invention, the markers additionally correspond to boundaries of processing blocks used in a speech coder.

The present invention modif ies a speech signal so that its energy distribution in time is changed and where this modified energy distribution in time increases the efficiency of waveform interpolation and sinusoidal coders.

The present invention creates a second speech signal for the purpose of speech coding from a first speech signal and omits or repeats pitch cycles to reduce the delay or advance of the second signal relative to the first signal.

Although a preferred embodiment of the apparatus of the present invention has been illustrated in the accompanying Drawings and described in the foregoing Detailed Description, it is understood that the invention is not limited to the embodiment disclosed, but is capable of numerous rearrangements, modifications and substitutions without departing form the spirit of the invention as set forth and defined by the following claims.

What is claimed is:

1. A method for pre-processing speech signals comprising the steps of:

computing a first pitch period track;

determining cycle markers and corresponding pitch periods based on the first pitch period track;

computing a first set of refined cycles;

determining if a second set of refined cycles is necessary;

computing a second set of refined cycles if determined to be necessary;

concatenating the first set of refined cycles;

concatenating the second set of refined cycles if computed, and thereafter combining the first set of concatenated refined cycles with the second set of concatenated refined cycles.

2. The method for pre-processing speech signals, as recited in claim 1, further comprising the step of filtering one of the combined cycles and the first set of concatenated refined cycles.

3. The method for pre-processing speech signals, as recited in claim 1, wherein the step of computing a first pitch period track comprises the steps of:

estimating pitch periods of a linear-prediction residual of the speech signal to obtain a plurality of pitch period estimates; and linearly interpolating the pitch period estimates to obtain the first pitch period track.

4. The method for pre-processing speech signals, as recited in claim 3, wherein the step of computing a first pitch period track further comprises the step of rounding values of the first pitch period track to an integer number of sampling intervals.

5. The method for pre-processing speech signals, as recited in claim 3, wherein the step of estimating pitch periods of the linear-prediction residual of the speech signal includes obtaining respective pitch period estimates at pre-determined intervals.

6. The method for pre-processing speech signals, as recited in claim 1, wherein the step of determining cycle markers and pitch periods based on the first pitch period track comprises the step of recursively processing the first pitch period track.

7. The method for pre-processing speech signals, as recited in claim 6, wherein the cycle markers depend only on the first pitch period track and an initial cycle marker.

8. The method for pre-processing speech signals, as recited in claim 1, further comprising the step of buffering the pitch periods and corresponding cycle markers.

9. The method for pre-processing speech signals, as recited in claim 1, wherein at least one said step of computing a set of refined cycles comprises at least one of the following steps:

providing a default estimate of refined cycles;

aligning refined cycles;

centering a pitch pulse of a selected refined cycle; and removing or repeating a selected refined cycle.

10. The method for pre-processing speech signals, as recited in claim 9, wherein the step of aligning refined cycles comprises the steps of:

determining a maximum of a plurality of measures of similarity respectively associated with adjacent pairs of possible refined cycles; and skipping or repeating samples in a selected refined cycle.

11. The method for pre-processing speech signals, as recited in claim 10, wherein the step of skipping or repeating comprises the step of skipping at least one sample, but no more than five percent of a total number of samples of the selected refined cycle.

12. The method for pre-processing speech signals, as recited in claim 10, wherein the step of skipping or repeating comprises the step of repeating at least one sample, but no more than five percent of a total number of samples of the selected refined cycle.

13. The method of claim 10, including determining if an offset indicator associated with the linear-prediction residual signal is equal to zero and skipping or repeating samples in a selected refined cycle if the offset indicator is determined to be unequal to zero.

14. The method for pre-processing speech signals, as recited in claim 9, wherein the step of centering a pitch pulse comprises the steps of:

computing a concentration parameter associated with the selected refined cycle;

determining if the concentration parameter is above a threshold;

if it is determined that the concentration parameter is above the threshold, determining if a local offset indicator associated with the linear-prediction residual signal requires an adjustment; and adjusting the local offset indicator if it is determined that the local offset indicator requires the adjustment.

15. The method for pre-processing speech signals, as recited in claim 1, wherein the step of determining if a second set of refined cycles is necessary comprises the step of determining an onset of a voiced region of the speech signal.

16. A method of pre-processing a speech signal to be input to a speech coding apparatus, comprising:

receiving the speech signal;

producing in response to the received speech signal a modified speech signal and a plurality of markers respectively indicative of relatively low signal energy points in the modified speech signal, including outputting the modified speech signal from a speech synthesis filter; and providing the modified speech signal and the plurality of markers to a speech coding apparatus that can produce therefrom encoded information from which a speech decoding apparatus can reconstruct the modified speech signal.

17. The method of claim 16, including the speech coding apparatus performing block processing on the modified speech signal, said performing step including using the markers as boundaries of blocks that are being processed.

18. The method of claim 17, wherein said performing step includes a sinusoidal coder performing block processing.

19. The method of claim 17, wherein said performing step includes a waveform interpolation coder performing block processing.

20. An apparatus for pre-processing speech signals comprising:

a pitch period processor for computing a first pitch period track;

a cycle marker processor for determining cycle markers and corresponding pitch periods based on the first pitch period track;

a first refined cycle computer for computing a first set of refined cycles;

a second refined cycle computer for computing a second set of refined cycles;

a first concatenator for concatenating the first set of refined cycles;

a second concatenator for concatenating the second set of refined cycles;

a mixer for combining the first set of concatenated refined cycles with the second set of concatenated refined cycles to generate a combined output; and a linear-prediction synthesis filter for performing linear-prediction filtering on the combined output.

21. The apparatus for pre-processing speech signals, as recited in claim 20, further comprising a buffer coupled to said cycle marker processor for storing the pitch periods and corresponding cycle markers.

22. An apparatus for pre-processing a speech signal to be input to a speech coding apparatus, comprising:

an input for receiving a speech signal;

a speech pre-processor coupled to said input and responsive to said received speech signal for producing a modified speech signal and a plurality of markers respectively indicative of relatively low signal energy points in said modified speech signal, said speech pre-processor including a speech synthesis filter for producing the modified speech signal; and an output coupled to said speech pre-processor for providing said modified speech signal and said plurality of markers to a speech coding apparatus that can produce therefrom encoded information from which a speech decoding apparatus can reconstruct the modified speech signal.

* * * * *

UNITED STATES PATENT AND TRADEMARK OFFICE

CERTIFICATE OF CORRECTION

PATENT NO. : 6,223,151 B1
DATED : April 24, 2001
INVENTOR(S) : B. Kleijn et al.

It is certified that error appears in the above-identified patent and that said Letters Patent is hereby corrected as shown below:

Title page,
Item [73], replace "Telefon Aktie Bolaget" with --Telefonaktiebolaget --

Column 1,
Line 14, replace "signal s" with -- signals --

Column 2,
Line 24, replace "very" with -- Very --

Column 6,
Line 37, replace "m (g)" with -- m (q) --
Line 38, replace "P (g)" with -- P (q) --
Line 49, replace "g" with -- q --

Column 7,
Line 2, replace "P (g)" with -- P (q) --
Line 35, replace "g" with -- q --
Line 67, replace "P (q)" with -- P (q) . --

Column 9,
Line 24, replace "modif ies" with -- modifies --
Line 51, add -- and -- after "cycles;"

Signed and Sealed this

Ninth Day of July, 2002

*Attest:*

*Attesting Officer*

JAMES E. ROGAN
*Director of the United States Patent and Trademark Office*